United States Patent [19]

Wiedemann

[11] 4,377,475

[45] Mar. 22, 1983

[54] APPARATUS FOR SUCKING UP AND HOLDING SLUDGE

[76] Inventor: Karl Wiedemann, Haldenloh 2 B, 8901 Welden, Fed. Rep. of Germany

[21] Appl. No.: 295,355

[22] Filed: Aug. 24, 1981

[30] Foreign Application Priority Data

Sep. 10, 1980 [DE] Fed. Rep. of Germany ..... 3034058

[51] Int. Cl.[3] ..... B01D 21/26

[52] U.S. Cl. ..... 210/136; 210/241; 210/355; 210/409; 210/416.1; 210/512.2

[58] Field of Search ..... 210/117, 136, 241, 242.1, 210/256, 258–261, 295, 355, 409, 416.1, 512.1, 512.2

[56] References Cited

U.S. PATENT DOCUMENTS

| | | | |
|---|---|---|---|
| 1,295,056 | 2/1919 | Otterson | 210/241 |
| 1,331,239 | 2/1920 | Cartwright | 210/241 |
| 2,010,538 | 8/1935 | Evans | 210/241 X |
| 2,240,167 | 4/1941 | Adams | 210/241 X |
| 3,013,665 | 12/1961 | Schmidt et al. | 210/241 |
| 3,463,172 | 8/1969 | Naylor | 210/241 X |
| 3,840,120 | 10/1974 | Greenberg | 210/258 X |
| 4,310,423 | 1/1982 | Brown et al. | 210/242.1 X |

FOREIGN PATENT DOCUMENTS

| | | | |
|---|---|---|---|
| 2719599 | 8/1978 | Fed. Rep. of Germany | 210/241 |
| 2824662 | 1/1979 | Fed. Rep. of Germany | 210/241 |
| 273 6587 | 5/1980 | Fed. Rep. of Germany . | |
| 7808346 | 2/1979 | Netherlands | 210/241 |

*Primary Examiner*—Robert H. Spitzer

*Attorney, Agent, or Firm*—Allison C. Collard; Thomas M. Galgano

[57] ABSTRACT

In the case of an apparatus for sucking up and holding sludge, use is made of a sludge tank which may be evacuated. The sludge tank has a sludge door and a water outlet able to be put into operation separately from the door. The water outlet is made up of an overflow line joined up with water in the sludge tank by way of a filter unit, the filter unit having a cleaning unit with at least one nozzle for jetting water onto the filter unit. Continuous operation is made possible in that the water outlet may be put into operation using a low pressure pump placed between the end of the overflow line, the inlet end at the filter of the overflow line being at a higher level than the low pressure pump, and the inside cross-section of the pump inlet and the inside cross-section of the overflow line are, in each case, greater than the cross-sections, answering thereto, of a pump having atmospheric pressure acting on its inlet side otherwise of the same size and the cleaning unit is designed to be acted upon by filtered water coming from the low pressure pump.

15 Claims, 2 Drawing Figures

APPARATUS FOR SUCKING UP AND HOLDING SLUDGE

BACKGROUND OF THE INVENTION

The invention is with respect to an apparatus for sucking up and holding sludge, more specially in the form of a sewer cleaning and/or clearing vehicle, having a suction line opening into a sludge tank on a carriage, the tank having a sludge outlet with a sludge outlet door for shutting it, and a water outlet, able to be used separately therefrom, the water outlet having an overflow line having, at an inlet end thereof, a filter unit in the sludge tank, and at least one jet cleaning unit for jetting water onto said filter unit.

An apparatus on these general lines is to be seen in German Auslegeschrift specification No. 2,736,587 in the form of a sewer cleaning vehicle in which water is processed. In the case of this known system, the overflow line is designed opening into a water tank from which water is taken by a high pressure pump and pumped into a clearing hose which may be lowered into a sewer to be cleaned. The overflow line is, in this case, put into operation by putting the sludge tank under pressure. The filter unit is cleaned by water coming from the high pressure pump. A shortcoming in this respect is that, for forcing the water from the sludge tank into the water tank, suction operation, taking place on evacuating the sludge tank, has to be stopped for the time being. Furthermore, the flushing operation using the clearing hose has to be stopped. Because some of the water coming from the high pressure pump is used for filter cleaning, there will be a drop in the pressure in the clearing hose to such a level that the jet of water coming from the clearing hose and used for cleaning purposes, is shut down. For this reason, no non-stop operation of this known system is possible.

General Outline of the Invention

Taking this part of the prior art as a starting point, one purpose of the present invention is to take care of the shortcomings of known systems and to make such a design of apparatus of the sort in question using simple and low-price parts that it is not only possible for the apparatus to take up a large amount of sludge and to give a high-level cleaning effect using water, but furthermore, at the same time, to make possible operation without stopping.

For effecting this purpose, the water outlet may be put into operation using a low pressure pump placed between the ends of the overflow line, the inlet end at the filter of the overflow line being at a higher level than the low pressure pump, and the inside cross-section of the pump inlet and the inside cross-section of the overflow line are, in each case, greater than the cross-sections, answering thereto, of a pump having atmospheric pressure acting on its inlet side otherwise of the same size and in that the cleaning unit is designed to be acted upon by filtered water coming from the low pressure pump.

These measures make certain that, for pumping of water, it is not necessary to let air into the sludge tank for the time being. The low pressure pump used for this purpose is, because of the way it is placed in circuit, not dependent on the atmospheric pressure at its inlet or section side. In fact, the working spaces of the pump are filled by gravity and because of the increase in the cross-section in the design of the invention, the water rate needed, dependent on the uptake volume of the low pressure pump, may be fully covered, even if the vacuum in the sludge tank is generally complete. For this reason, it is possible, giving a useful effect, for sludge to be sucked up and, at the same time, for water to be forced out. Because the filter unit gets its cleaning water by way of the low pressure pump, any high pressure unit used for cleaning sewers is able to be used without any trouble in this respect and furthermore there is no stopping the operation of the apparatus in any respect. The useful effects which may be produced with the invention are, for this reason, to be seen in the very low running and plant costs.

A further useful development of the general teaching of the invention is to the effect that the cleaning unit, used with the filter unit, has the input line leading to it branched from a part, coming downstream from the low pressure pump, of the overflow line and in that this part of the overflow line has a shut-off valve placed downstream from the point of branching off of the input line, the valve being more specially an adjustable check valve, and with a pressure-worked switch coming upstream from the check valve, the pressure-worked switch being used for turning off the low pressure pump, which is more specially designed as a rotary piston pump. With such a system it is possible to make certain that the pumping effect of the pump is certainly used for building up the pressure needed by the cleaning unit and that the pump is automatically put out of operation once this pressure goes down to a low value, that is to say as soon as the water has been pumped out of the sludge tank.

A further useful measure of the invention is to the effect that the sludge tank has a sieve separating wall, of which part is a door and which, more specially, is water-tight in its lower part, such separating wall separating the space in the tank with the filter unit in it from a space in the tank with the suction line in it. With this design, a first stage of cleaning of the water running to the filter unit is effected. If the filter separating wall is water-tight in its lower part, there is the useful effect that, generally speaking, only overflowing water makes its way into the space with the filter unit in it so that there is hardly any deposit of sand or sludge, this more specially being a useful effect if the filter unit is fixed in position. A fixed-position filter unit is very simple from the design point of view and makes it readily possible to keep forces under control, which are more specially likely when the apparatus is moving at high speeds for transport purposes. It is best for such a filter unit to be placed halfway up the space in question so that, with a filter under water, the water round the filter is kept as free as possible of suspended materials and furthermore settling materials.

LIST OF FIGURES

Further useful developments and outgrowths of the general teachings of the present invention will be seen from the account now to be given of one working example using the figures, to be taken in connection with the rest of the claims.

DETAILED ACCOUNT OF WORKING EXAMPLE OF THE INVENTION

Figure 1:
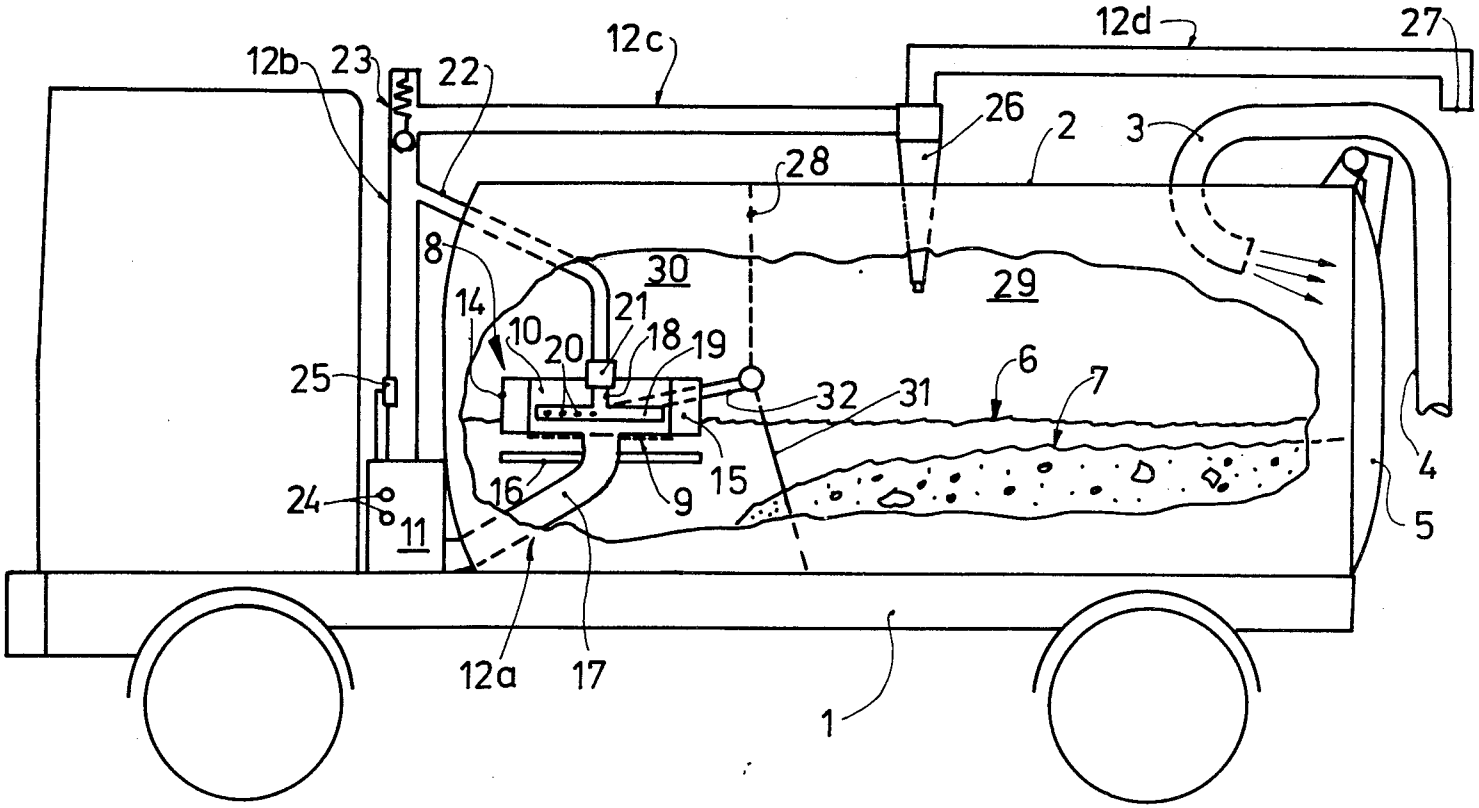
FIG. 1 is a sludge take-up vehicle of the present invention.

The general design and function of a sludge take-up vehicle or sewer cleaning vehicle are known and, for this reason, not in need of a detailed account here. The vehicle designed for sucking up sludge to be seen in FIG. 1, is made up of a tipping, barrel-like sludge tank 2 supported on a vehicle chassis 1. A suction line 4 which may be lowered into the sewer to be cleaned, has an outlet end 3 opening into the tank 2. For putting the suction line into operation, the sludge tank 2 is evacuated in a way which need not be detailed here. The sludge tank 2 has an outlet with a rocking door 5. For tipping out the tanked sludge onto a dumping ground, door 5 is turned upwards and, at the same time, the complete barrel-like sludge tank 2 is tipped, that is to say one end lifted.

On taking up sludge from a sewer, it is normal for a very great amount of water to be taken up into the suction line 4 and, for this reason, into the sludge tank 2. In the present working example, the level of the water at a given time is marked at 6. The top edge of the sludge within the tank under water is marked 7. For increasing the amount of sludge which may be stored in the tank 2, the water is let off by way of a water outlet and then makes its way into the sewer to be freed of sludge.

For this purpose, a take-up vessel 8 is present, whose floor is, at least in part, in the form of a filter structure 9 and its inner space 10 is joined up with an overflow line coming from the tank 2 and having between its two ends a low pressure pump 11. The take-up vessel 8 is best placed half the way up the inner space within tank 2 and is fixed to the inside of the tank. In FIG. 1 the take-up vessel 8 is designed as a bouyant body floating on top of the water. The part 12*a*, running into the sludge tank 2, of this overflow line is made so that it may be moved for this purpose. This is best made possible by using a simple high pressure hose. Part 12*a* of the overflow line is, for this reason, able to keep up with motion of the bouyant take-up vessel 8, whose level is automatically kept the same as the water level in the sludge tank 2, the filter structure or filter floor 9 forming the floor of take-up vessel 8 being under water, even if the water level in the tank is low, because of the low draught of the take-up vessel 8. The filter structure is best made up of a supporting sieve plate on which a filter made up of a fine netting material is placed.

The side wall, walling in the inner space 10 of the take-up vessel 8 to the side has one or more bouyancy spaces 14, 15. Under the filter wall 9 there is, placed at a small distance therefrom, a round support plate 16 to make certain that, when the water level goes down, the filter structure 9 does not come to rest on the filling of sludge in the sludge tank 2 itself. The round support plate 16 may be simply fixed to the overflow line, whose connection part joining with the take-up vessel 8 may be simply designed as a pipe elbow 17.

Filter structure 9 has a cleaning unit and, to this end, in the present working example, is is made of a T-like turning head 18 made up of pipes and placed within the space 10 of the take-up vessel 8, head 18 having a cross-bar 19 with nozzles and placed parallel to the filter structure 9. The nozzles 20, on nozzle bar 19, are placed pointing towards the inner side of the filter structure 9. The moving head 18 is designed to be turned about an axis of turning which is generally normal to the filter structure 9. The bearing 21 used to make this possible, may be fixed to the cover shutting off the top end of the inner space 10. The nozzles 20 are at a small slope in relation to the upright axis of turning so that the head 18 is automatically turned when the nozzles 20 are put under pressure because of the recoil effect, and when so turned, the nozzle bar 19 is responsible for jetting water onto the complete upper face of the filter structure 9. For input of water to nozzles 20, the head 18, made up of pipes, is joined up by way of a turning joint with an input line 22 branching off from a part (on the pressure side) 12*b* of the overflow line, this point of branching being downstream from the low pressure pump 11. The part of the input line 22 which is in the tank 2 and is near the take-up vessel, is made so that it may be moved for the same reason as was the case with the inner part 12, such a moving design being produced by using a simple hose. Once the low pressure pump 11 has been put into operation for pumping water from the sludge tank 2, the nozzle bar 19 is put into operation at the same time. The cleaning jets coming from the nozzles 20 have the effect of forcing the grains of dirt resting on the filter structure 9 and therein, back into the sludge tank 2. The jets going through the filter structure 9 are stopped under the filter structure by the round support plate 16 so that there is not stirring up of the sludge because of this effect.

The pressure needed for running the jet bar 19 is produced by the pressure build-up in the part 12*b*, coming downstream from pump 11, of the overflow line. For this purpose, there is a shut-off valve (which in the present case is best designed as a spring-loaded adjustable check valve 23) placed downstream from the point of branching off of the input line 22, this check valve 23 only opening the line cross-section when in part 12*b* the desired pressure build-up has taken place in the overflow line, as is needed for operation of the cleaning unit. The low pressure pump 11, which is best in the form of a centrifugal pump, may, in the case of automatic operation, simply be put into operation by a float-worked switch placed in the sludge tank. In the present working example in question, the low pressure pump 11 is to be turned on using a pushbutton worked by hand. The buttons of switches are marked at 24. In this respect, the filling level in the sludge tank may be seen by way of a viewing glass (not figured). Once the water level has reached a certain height, low pressure pump 11 is turned on with the effect that, at least as much water is pumped out of the sludge tank 2 as comes into it by way of suction line 4, this offering the useful effect of continuous suction operation, that is to say continuous till the sludge tank 2 is filled up with sludge. The switching off of pump 11 when there is no more water space in the sludge tank 2 takes place automatically for stopping any damage to the low pressure pump 11. For this purpose, in the part 12*b* on the pressure side of the overflow line, there is a pressure-worked switch 25, which only keeps pump 11 turned on till a given pressure build-up has taken place and the pump 11 is then switched off once there is a sharp drop in this pressure. This furthermore makes certain that, if on starting up the pump 11, the desired pressure build-up does not take place at once, further operation of the pump will not be possible.

The take-up vessel 8 is so placed that it is, at all times, at a higher level than the low pressure pump 11 so that the water coming from the low pressure pump 11 will be flowed by the effect of gravity as well, if the sludge tank 2 is evacuated. The inside cross-section of the part 12*a* on the suction side of the overflow line is of such a size that, even without the effect of atmospheric pressure, the amount of water coming in is great enough for keeping the pump 11 going. The same is naturally true for the pump outlet cross-section. It has become clear from experience that all that is necessary in this respect is if these cross-sections are about 3 to 4 times greater than cross-sections, answering thereto, of a pump of the same size, whose inlet side is at atmospheric pressure. In use, the low pressure pump 11 makes possible a suction rate of about 1600 liters a minute. The outlet pipe of such a pump normally has a diameter of 80 mm and for the use of the pump in the present invention, an output pipe diameter of about 150 mm would be needed. In this case very high level suction effects are produced even though the degree of evacuation of the sludge tank is generally 98%.

The sludge tank 2 is cut up by a sieve wall 28 and two spaces 29 and 30, of which the larger space 30 has within it the outlet ends 3 of the suction line 4 and the smaller space 29 is used for the bouyant take-up vessel 8. The sieve wall 28 keeps back large grains of solid material in space 29, this being responsible for a first stage of cleaning of the water making its way through the filter structure 9 while at the same time makes certain that the building up of sludge in space 30 takes place more slowly than in space 29 so that the take-up vessel 8 is given a great amount of free space for a long time of operation (this design may be made even better if the sieve wall 28 is liquid-tight in its lower part, in which the building up of sludge firstly takes place, such a design being more specially useful in a case in which the take-up vessel 8 is fixed in position. To be on the safe side, an overflow line (which in the present case is not detailed in the figure and may be shut off by a valve) is placed running out of space 30 and by way of this overflow line, sludge may be let off when the sludge tank 2 is put under pressure). The sieve wall 28 has a turning door part 31, which, in its resting position, is at a small slope and which, when the tank is tipped for emptying, lets the sludge make its way out of space 30 so that any deposit of fine sludge may be cleared from the tank. Because door 31 is placed at a slope, there will be no motion backwards and forwards when the tank is underway. The take-up vessel 8, which in the present case is bouyant, may be fixed to a turning U-like guide part 32, which has a very good stabilizing effect and keeps the take-up vessel 8 in place when the sludge is tipped out of the tank.

The overflow line may be designed running out into the space round the apparatus downstream from the check valve 23, or may be further used.

In the present working example, for further cleaning of the water after filtering, use is made of a hydrocyclone 26 which has its inlet joined up with a further part 12*c*, coming downstream from the check valve 23, of the overflow line. The lower outlet end, letting off the separated dirt, of the hydrocyclone 26 is designed opening into the sludge tank 2. A further part 12*d* of the overflow line is joined up with the top overflow of the hydrocyclone 26 taking up water, this further part 12*d* having an outlet cross-section opening at a position near the apparatus to be seen in FIG. 1, the water, after the second cleaning stage running out by way of cross-section 27 at some position near the apparatus.

The use of the low-pressure pump 11, able to be run with a desired pumping effect without any atmospheric pressure on the suction side, for pumping off water, that is to say for putting the overflow line 12 into operation and for running water onto the filter structure 9 by way of the cleaning unit, makes possible a suction and flushing operation at the same time without stopping, that is to say uninterruptedly.

Figure 2:
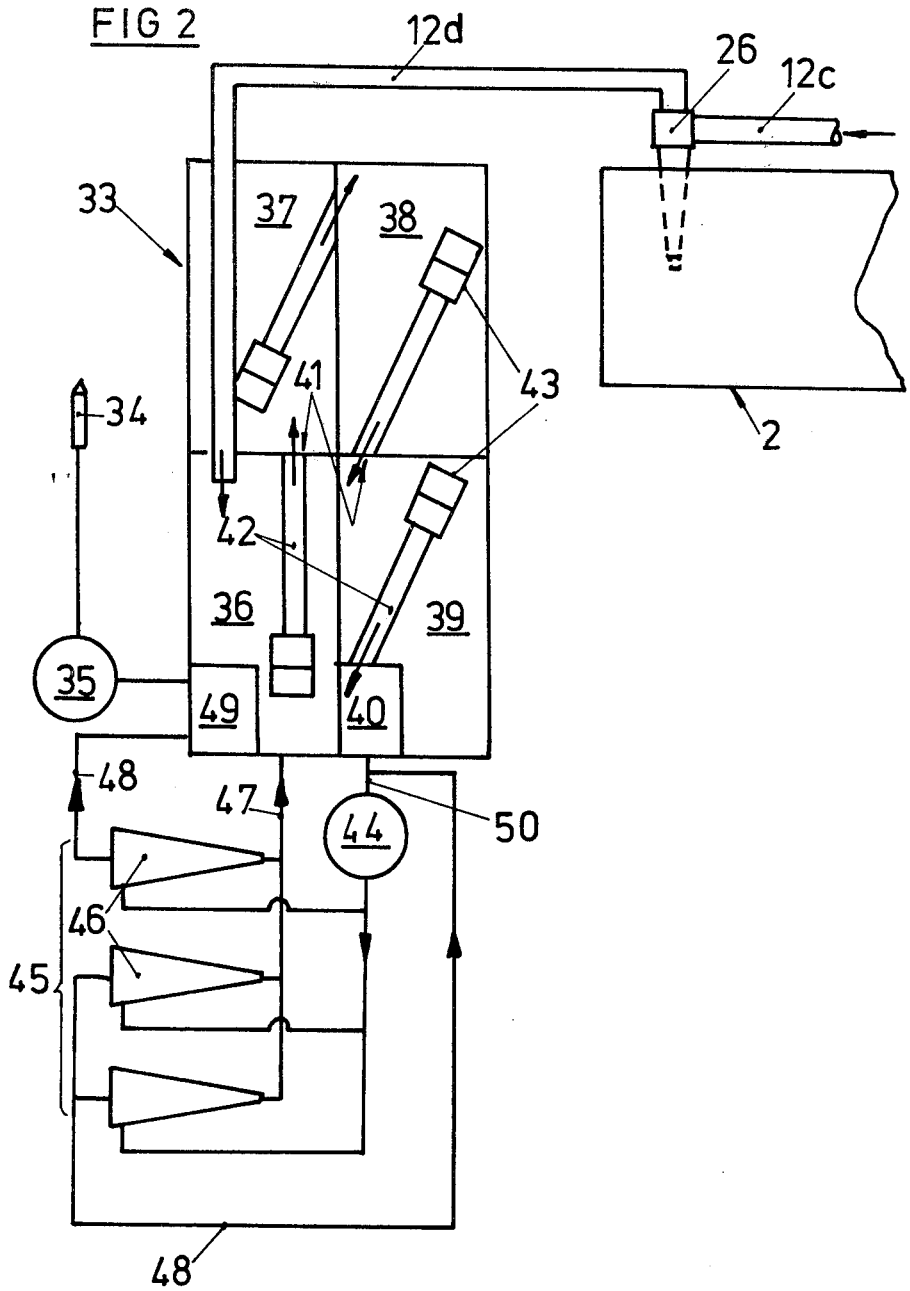
FIG. 2 is a diagrammatic plan view of a sewer cleaning vehicle of the invention.

The part 12*d* coming downstream from the hydrocyclone 26, of the overflow line may be seen in FIG. 2 to have its opening into the water tank 33, with which the high pressure pump 35 may be joined for freely sucking up water. In the working example of FIG. 2, the water, coming into the water tank 33 undergoes settlement and a second stage of cleaning and, for this purpose, the water tank 33 is separated by vertical separating walls into a number of settlement spaces 36 to 40, which are joined up together in each case by way of an opening 41 placed at the floor of the space in question. At openings 41 there are overflow connections 42, running into that settlement space which is further downstream in each case, the overflow connections 42 being able to be moved and having floats 43 at their inlet ends so that it is only water cleaned by settlement from a position near the surface which may make its way into the next space. The last settlement space 40, that is to say the one furthest downstream is used as a header which may be joined up with the high pressure pump 35. In the working example in question, the header, formed by the settlement space 40, is joined up with a further low pressure pump 44 for pumping water to a hydrocyclone system 45 placed on the inlet side of high pressure pump 35, the water being further cleaned here. The cyclone system 35 is made up of three hydrocyclones 46, whose lower ends 47, for letting off dirt, are designed opening into the sludge tank 2, or, in the present working example into the first settlement space 36 of the water tank 33. The overflow 48 with the cleaned water of a hydrocyclone 46 will be seen to be opening into a header 49 placed on the inlet side of the high pressure pump 35, the header being simply placed within the first settlement space. The overflows 48 of the further hydrocyclones 46 are shortcircuited for increasing the cleaning effect, that is to say joined up with the suction connection 50, joined up with the header 40, of the low pressure pump 44. The sludge tank 2 and the water tank 33 are to be seen as block diagrams in FIG. 2 to make the figure simpler. Putting the invention into effect, the water tank 33 may take the form of a single-piece box, as part of the body of the vehicle and having generally the same breadth as the vehicle and having, in its middle, a lower part for taking up the sludge tank 2 which is best made barrel-like. Such a design gives the useful effect of the superstructure of the vehicle being symmetrical and not only makes best use of the space on hand of the largest possible settlement area, but furthermore makes certain that the axles of the vehicle are equally loaded.

I claim:

1. In an apparatus for sucking up and holding sludge, having a suction line opening into a sludge tank on a carriage having a sludge outlet with a sludge outlet door, and a water outlet able to be used separately therefrom, the water outlet having an overflow line with, at an inlet end thereof, a filter unit in the sludge tank, and at least one nozzle cleaning unit for jetting water onto the said filter unit, the invention residing in that said apparatus has a low pressure pump for putting said water outlet into operation, the overflow line running through said pump, the overflow line having an inlet placed at a higher level than said low pressure pump, and said pump having an inner inlet cross-section greater than the inner inlet cross-section of a pump, designed for running with its inlet at atmospheric pressure but otherwise of equal size, in that the cross-section of the part of the overflow duct on the suction side is greater than the inlet of a pump designed for running with its inlet at atmospheric pressure but otherwise of equal size, and in that the low pressure pump is joined up with the cleaning unit for pumping filtered water thereto.

2. The invention as claimed in claim 1, having a suction pipe as a suction part of said overflow line, a shut off take-up vessel joined with the suction pipe, a floor of said vessel which has a filter structure, and a bar with nozzles as part of said cleaning unit, said bar being parallel to said floor and being designed to be turned about an axis normal to said floor, said nozzles pointing at a small angle in relation to said axis.

3. The invention as claimed in claim 2, wherein the take-up vessel of the cleaning unit is in the form of a bouyant body fixed to a turning U-like part and in that the part, running into the sludge tank and joined up with the filter unit, of the overflow line is designed to be moved.

4. The invention as claimed in claim 3, wherein the part of the overflow line joined up with the filter unit has a guard plate placed round it, the guard plate being placed under and spaced from the filter structure.

5. The invention as claimed in claim 1 or claim 2, having an input line for input of water to said cleaning unit, said input line branching off from a part of said overflow line at a point on the downstream side of said low pressure pump, and a shut-off valve placed downstream from said point of branching, and a pressure-worked switch in such part of the overflow line at a point on the upstream side of the valve, said switch being designed for turning off said low pressure pump.

6. The invention as claimed in claim 5, wherein said valve is an adjustable check valve.

7. The invention as claimed in claim 5, wherein said low pressure pump is a rotary piston pump.

8. The invention as claimed in claim 5, having at least one hydrocyclone placed downstream from said shut-off valve in the overflow line, said hydrocyclone having a lower outlet opening into said sludge tank.

9. The invention as claimed in claim 1, having a further water tank, a high pressure pump for taking water from said water tank, and a cleaning nozzle to be powered by said high pressure pump, the overflow line opening into said water tank, said water tank being cut up into a number of settlement spaces placed in series and joined together by pipe connections placed at opening near the floors of such spaces, inlet ends of such connection pipes being bouyant and running into the next more upstream settlement space.

10. The invention as claimed in claim 9, having a further low pressure pump, with an inlet joined up with the settlement space furthest upstream, for pumping water to the high pressure pump and between the high pressure pump and the low pressure pump upstream therefrom, the apparatus has a number of hydrocyclones with top openings joined up partly with the suction connections of the low pressure pump.

11. The invention as claimed in claim 1, having a sieve wall cutting up the sludge tank into one space with the filter unit in it and a further space with the suction line running into it, the sieve separating wall having a moving door.

12. The invention as claimed in claim 11, wherein said sieve separating wall is liquid-tight in its lower part.

13. The invention as claimed in claim 11, wherein the filter unit is placed about halfway up the space within the tank in which it is placed.

14. The invention as claimed in claim 11, wherein the space of the sludge tank having the filter unit has an overflow line which is able to be shut off by a valve, such line being put into operation when the sludge tank is put under pressure.

15. The invention as claimed in claim 1, additionally including a vehicle on which said apparatus is mounted.

* * * * *